US007195563B1

(12) United States Patent
Martens

(10) Patent No.: US 7,195,563 B1
(45) Date of Patent: Mar. 27, 2007

(54) ADJUSTABLE PUTTING GREEN FOR GOLF PRACTICE

(76) Inventor: David A. Martens, #6, 2630 Bouquin Crescent W., Abbotsford, British Columbia (CA) V2S 5N7

( * ) Notice: Subject to any disclaimer, the term of this patent is extended or adjusted under 35 U.S.C. 154(b) by 1 day.

(21) Appl. No.: 11/029,133

(22) Filed: Jan. 3, 2005

Related U.S. Application Data

(60) Provisional application No. 60/534,020, filed on Jan. 2, 2004.

(51) Int. Cl.
*A63B 69/36* (2006.01)

(52) U.S. Cl. ..... 473/160

(58) Field of Classification Search ..... 473/160, 473/161, 279
See application file for complete search history.

(56) References Cited

U.S. PATENT DOCUMENTS

| | | | | |
|---|---|---|---|---|
| 2,465,418 | A * | 3/1949 | Baker | 473/160 |
| 3,366,388 | A * | 1/1968 | Del Raso | 473/153 |
| 3,595,581 | A * | 7/1971 | Anderson et al. | 473/161 |
| 3,601,407 | A * | 8/1971 | Lorrance | 473/160 |
| 4,211,417 | A * | 7/1980 | Brown | 473/160 |
| 4,247,112 | A * | 1/1981 | Del Raso | 473/153 |
| 4,978,127 | A * | 12/1990 | Juel, Jr. | 473/160 |
| 5,390,925 | A | 2/1995 | Wiltse | |
| 5,863,256 | A | 1/1999 | MacLean et al. | |
| 6,050,901 | A * | 4/2000 | Davis | 473/160 |
| 6,146,284 | A | 11/2000 | Russell | |
| 6,338,682 | B1 * | 1/2002 | Torchia et al. | 473/160 |
| 2005/0049070 | A1 * | 3/2005 | Lee et al. | 473/278 |
| 2005/0197196 | A1 * | 9/2005 | Ostiguy | 473/160 |

* cited by examiner

*Primary Examiner*—Mark S. Graham
(74) *Attorney, Agent, or Firm*—Todd N. Hathaway

(57) ABSTRACT

A practice putting green that is adjustable to provide a playing surface having a variety of contours. The assembly is formed of a plurality of narrow transverse support members that are arranged as segments in side-to-side relationship to define an elongate playing path. Carpet, artificial turf or other flexible material is placed atop the support members to form the playing surface. Inwardly facing wedges are mounted under the ends of the support members and are slid from side-to-side so as to selectively tilt the members and adjust the contour of the playing surface. The wedges on each segment are joined by a transverse rod so that both will move simultaneously in response to pressure on one of the wedges. The support members have a tray-shaped configuration with upwardly extending end walls, so that in combination they define an elongate channel. The layer of pliable material is received in the channel so that the edges thereof engage the walls of the channel on either side so as to hold the support members against shifting out of alignment from side-to-side.

15 Claims, 4 Drawing Sheets

ADJUSTABLE PUTTING GREEN FOR GOLF PRACTICE

RELATED APPLICATIONS

This application claims the benefit of U.S. Provisional Patent Application No. 60/534,020 filed on 2 Jan. 2004.

BACKGROUND a. Field of the Invention

The present invention relates generally to practice greens for use in the game of golf, and, more particularly, to a practice green having an upper surface that is adjustable to a variety of contours.

b. Related Art

Artificial greens are well known for practicing one's golf skills, and are a common fixture of homes, offices, course club houses, and "19$^{th}$ Holes". Typically, such practice greens have a surface covered with carpet or artificial turf and one or more holes into which the ball is putted.

Although traditional practice greens are useful to a degree, their benefits and enjoyability are limited by the fact that in most cases they are static structures which cannot be adjusted to provide added challenge or an element of variety. For example, many prior practice greens are simply long, flat surfaces, which provide no challenge above a certain level. In other cases practice greens have been made that incorporate certain obstacles, such as a small "sand trap" or "water hazard", but while they might add some challenge or entertainment value these features bear little or no resemblance to the conditions the golfer will encounter on a green on an actual course.

On actual putting greens, of course, the greatest challenge is usually provided by the uneven contour, with various slopes, breaks, swales, ridges, roll-overs and so on, so that one cannot simply putt the ball straight towards the hole and expect it to go in. In many courses these features are intentionally designed into the greens, and it is a critical skill of a master golfer to be able to "read" these contours so as to be able to effectively compensate for them in making a successful putt. In point of fact, the slopes and contours of the greens of many major golf courses are cataloged and studied in depth by both professional and amateur players.

Prior forms of practice greens have had very little ability to simulate these features. For example, U.S. Pat. No. 6,146,284 shows a practice putting green having panels that are supported on adjustable legs. While this does allow the slope to be adjusted, it does so only in a gross sense and there is little or no capability to develop subtle features, such as small ridges, swales and so on. Moreover, reliance on the individual height-adjustable legs means that adjustment is tedious, and stability and long-term durability are doubtful. A more basic variant on the same theme is shown in U.S. Pat. No. 5,863,256, in which the panels are supported from side rails having height adjusting screws. U.S. Pat. No. 5,390,925 shows a device in which the angle of the panel is adjusted by rotating polygonal supports at its corners.

Others have taken the expedient of simply placing a mound under the carpet or artificial turf, but this obviously offers little flexibility or adjustment, at least without having to provide (and store) large number of different mounds, ridges, and pieces having other shapes.

Accordingly, there exists a need for a practice putting green having a surface that is readily adjustable to a wide range of contours. Furthermore, there exists a need for such a putting green that permits varied and subtle contours to be formed within the overall lie of the surface. Still further, there exists a need for such a practice green assembly that is simple and convenient to adjust. Still further, there exists a need for such a practice green apparatus that employs a support mechanism that is both durable and stable in use.

SUMMARY OF THE INVENTION

The present invention has solved the problems cited above, and is a practice putting green that is adjustable to provide a playing surface having a variety of contours. Broadly, this comprises a plurality of transversely extending support segments arranged in side-by-side relationship so as to define an elongate playing path; at least one flexible layer placed over the segments so as to form a playing surface along the playing path; and means for tilting the support segments individually in a direction lateral to the playing path, so that the flexible layer that is supported thereby can be selectively raised or lowered from one side to the other so as to provide the playing path with a variety of contours.

Each of the support segments may comprise a transversely extending support tray having an upper surface for engaging the overlying layer of resiliently flexible material, and first and second wedge members having inwardly angled inclined surfaces in sliding engagement with opposite ends of the tray member. The wedge members may be commonly mounted to a transversely extending rod, so that the wedge members will slide together simultaneously in response to pressure on an outer end of one of the wedge members. The rod may pass through a cooperating bore in a center block, and stop pins may be mounted on the rod for reacting against side faces of the center block so as to limit side-to-side motion of the wedge members. The center block may be pivotedly or fixedly mounted to the tray member.

Each of the tray members may comprise a flat, narrow panel having upstanding wall portions at its ends for defining a shallow, upwardly facing section of channel, so that when a plurality of the segments are placed in side-to-side relationship the channel sections cooperate define an elongate channel for receiving the layer of flexible material therein. The layer of flexible material may have a width selected so that the edges thereof fit closely within the upstanding walls of the tray members, so that the material prevents the tray members from sliding from side to side as the wedge members are adjusted.

The at least one layer of flexible material may comprise a layer of resiliently flexible cushioning material overlain by a layer of carpet or artificial turf material.

These and other features and advantages of the present invention will be better understood by reading of the following detailed description with reference to the accompanying drawings, in which like reference numerals will refer to like structures.

DETAILED DESCRIPTION

Figure 1:
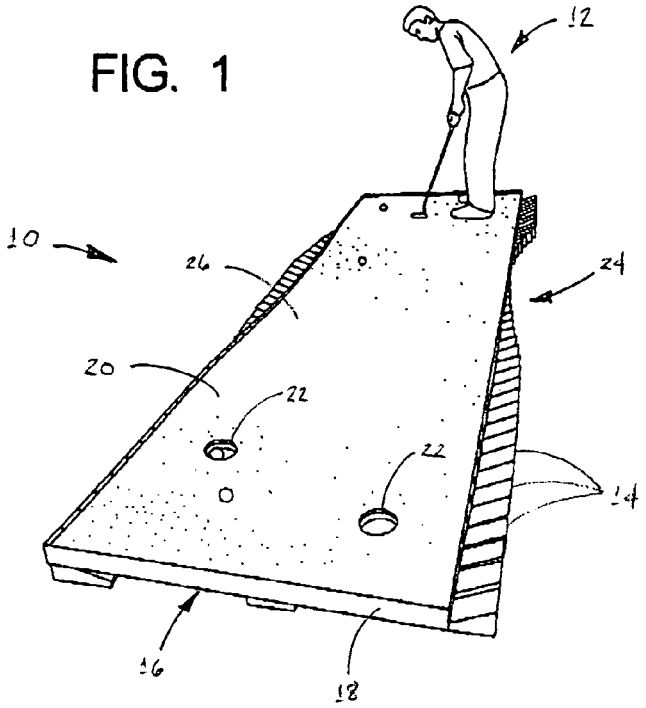
FIG. 1 is a perspective view of an adjustable practice green assembly in accordance with the present invention, showing this being used by putting across an undulating contour that is formed on the upper surface of the apparatus.

FIG. 1 shows an adjustable putting assembly 10 in use by a golfer 12. As can be seen in FIG. 1, the practice green assembly is composed of a plurality of transversely extending support segments 14 arranged adjacent to one another. As will be described in greater detail below, each of the segments includes a tray member that, when placed next its neighbors, forms a section of an elongate channel 16. The channel supports a layer of resiliently flexible, slightly compressible cushioning material 18, such as high-density foam, overlain by a thinner layer of carpet 20 or artificial turf material. Cups or holes 22 are formed in the carpet and cushion material near one end of the assembly, and are preferably sized to correspond to those on a regulation course.

Figure 2:
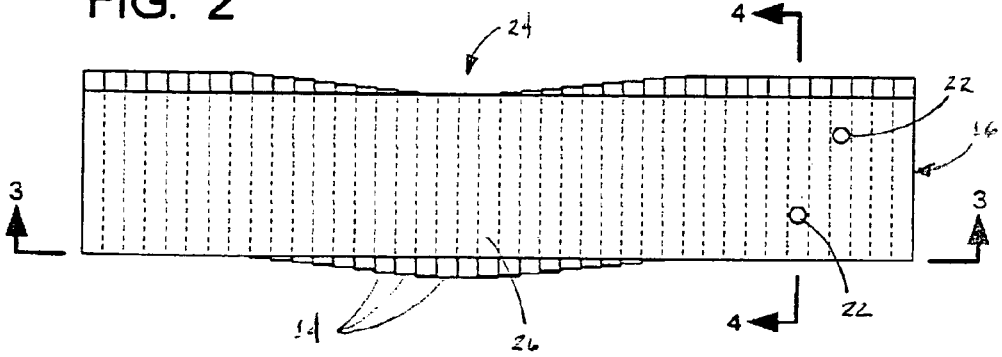
FIG. 2 is a top, plan view of the practice green assembly of FIG. 2, showing the segmented structure thereof in greater detail and illustrated in the manner in which the contour of the upper surface of the assembly is adjusted by shifting the individual segments from side to side.

As will be described in greater detail below, the height and slope of the putting surface is adjustable at each segment by sliding the wedge members of the segments from side-to-side, i.e., in a direction transverse to the long axis of the assembly. For example, FIG. 1 shows a group of segments 14 having been shifted to the right (from the perspective of the golfer) to create a gentle swale 26 to the right in the area 24 between the golfer and the target holes 22. As can be seen in FIG. 2, the narrow width of the support segments 14 enables these to be adjusted by slight amounts relative to one another, thus creating very realistic and subtle contours that effectively mimic those of a natural putting green.

Figure 7:
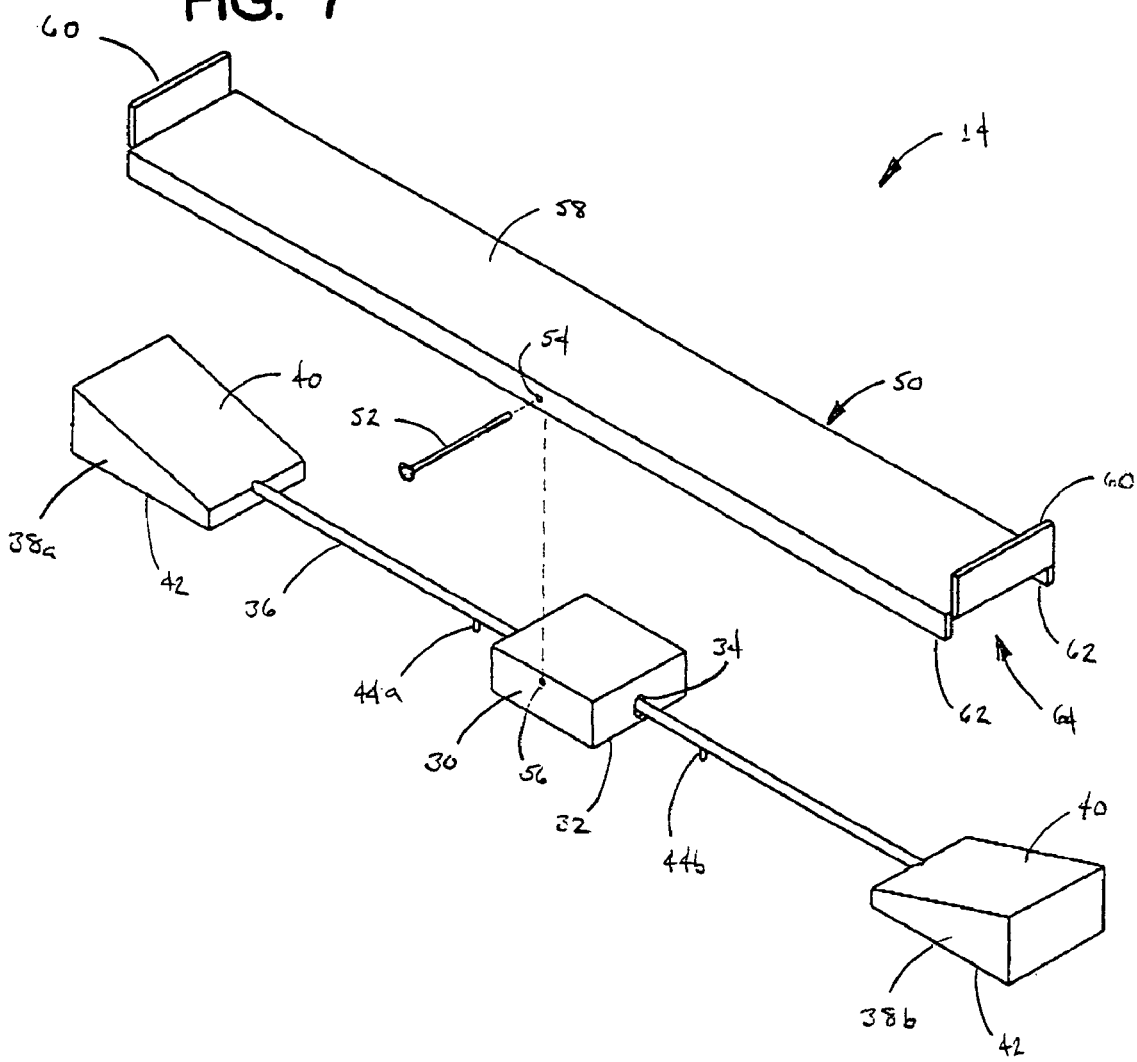
FIG. 7 is a perspective, exploded view of an individual one of the segment assemblies of the practice green of FIGS. 1–6, showing the components thereof in greater detail, and in particular the relationship of the sliding edge members and pivoting support plate to the central support member of the segment assembly.

FIG. 7 shows the construction of the individual support segments 14 in greater detail. As can be seen, each segment assembly includes a base block 30 having a lower surface 32 for resting on the floor or ground. The base block includes a transverse bore 34, with a rod member 36 passing through the bore in reciprocating, sliding relationship thereto. First and second wedge members 38*a*, 38*b* are mounted to the outer ends of the rod member 36, and each includes an inwardly angled upper surface 40 and horizontal bottom surface 42, the latter being in co-planar relationship with the bottom surface 32 of the central support block so that all three will rest on the floor/ground simultaneously. First and second depending stop pins 44*a*, 44*b* are mounted to the rod member on opposite sides of the support block 30, and serve to limit the lateral range of motion of the rod and wedge members.

The wedge member 38*a*, 38*b* and central support block 30 are suitably formed of rigid plastic material (e.g., extruded or molded plastic) having low compressibility and good strength and wear characteristics, while the rod member 36 is suitably formed of metal (e.g., steel or aluminum).

The tray member 50, in turn, is pivotedly mounted to the center block 30 by a pivot pin 52 that passes through cooperating bores 54, 56. The tray member has a flat, comparatively narrow panel 58 that spans the width of the segment assembly and that is bounded on its ends (i.e., the ends that will be on the left and right sides of the assembly) by upstanding wall portions 60. Depending walls or flanges 62 border the lateral edges of the panel 58, in turn, and include the bore 54 for the pivot pin 52. The width between the depending flanges 62 is just slightly greater than the width of the center block and wedge members 30 and 38*a*, 38*b*; the depending flanges 62 consequently define a channel 64 that fits over and receives the underlying plastic supports as the tray member rocks about pivot pin 52. The tray member is suitably formed of heavy gauge aluminum or steel sheet metal, cut and bent to form the upwardly and downwardly extending wall portions thereof.

Figure 3:
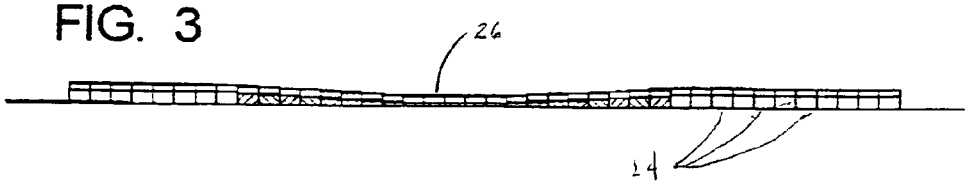
FIG. 3 is a side, cross sectional view of the practice green apparatus of FIGS. 1–2, taken along line 3—3 in FIG. 2, illustrating the manner in which the relative positions of the sloped portions of individual segments dictate the height and contour of the upper surface of the assembly.
Figure 4:
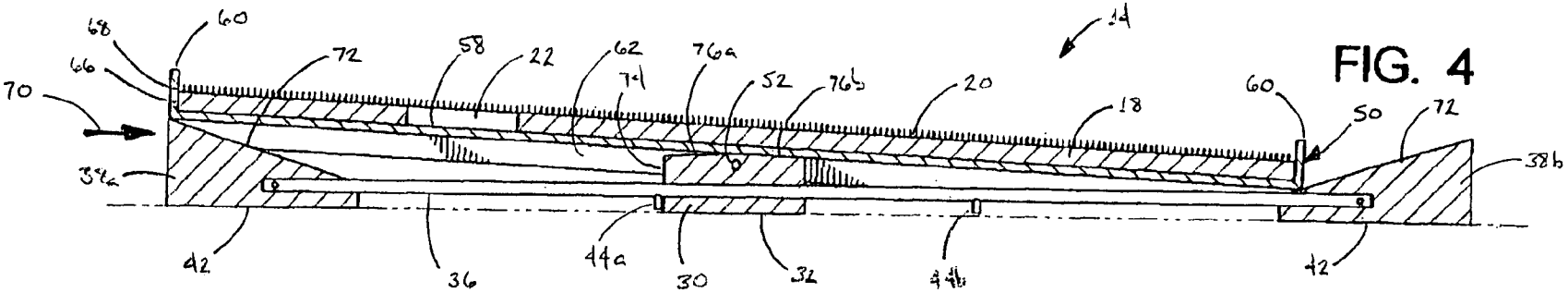
FIGS. 4–6 are end, cross sectional views of the practice green assembly of FIGS. 1–3, taken along line 4—4 in FIG. 2, showing the adjustable segments of the assembly in greater detail and illustrating the manner in which the opposing wedge members thereof adjust both the height and angle of the upper panel of the segment and the overlying surface material as they are shifted from side-to-side relative to one another.
Figure 5:
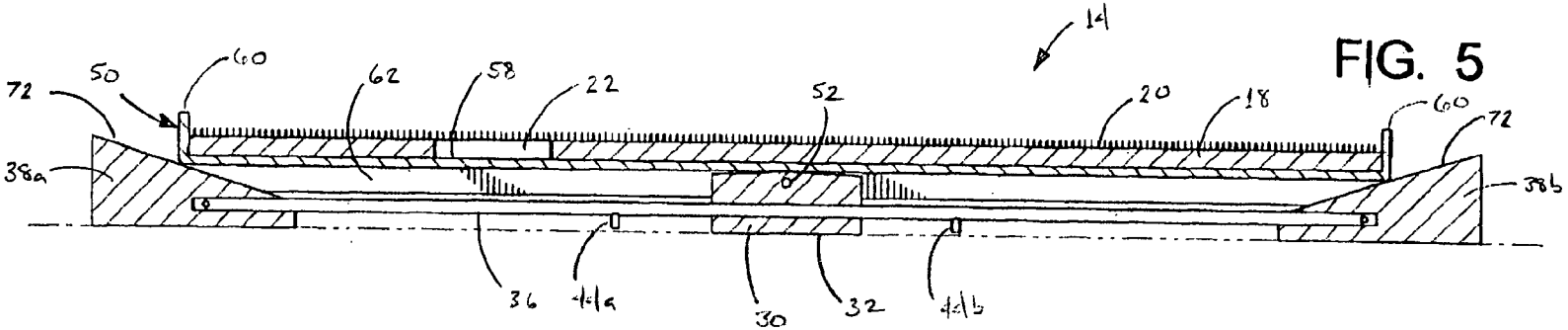
Figure 6:
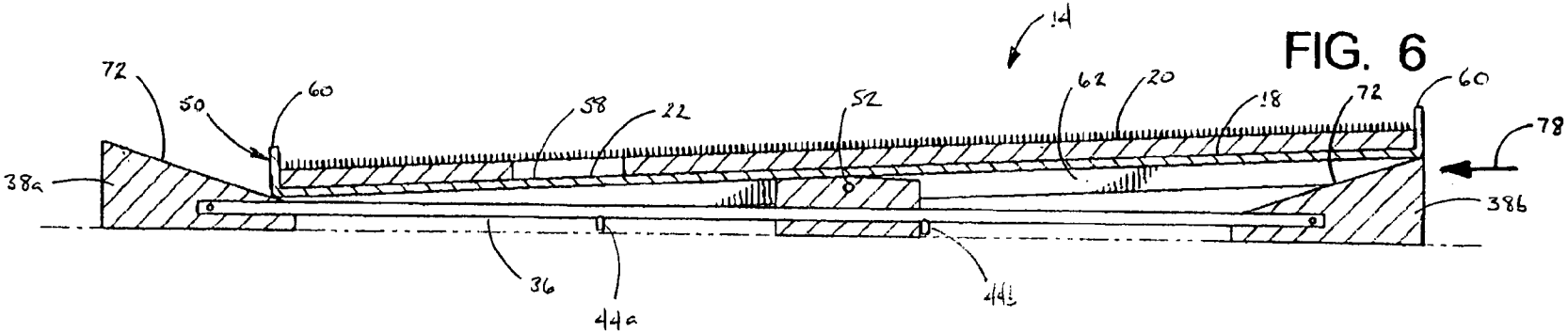

In end view (i.e., looking along the long axis of the assembly, as shown in FIGS. 1–3), the panel 58 and wall members 60 define a shallow, outwardly facing U-shaped channel section, so that when the segments are placed in side-by-side relationship they form a elongate, continuous channel into which the pad and turf layers 18, 20 are placed. As can be seen in FIGS. 4–6, the edges 66, 68 of the pad and carpet layers 18, 20 fit closely within the channel and butt up against the end walls 60 of the trays. Since the pliable pad and carpet layers are both continuous in the longitudinal direction, the engagement between the edges of these layers and the upstanding walls 60 of the tray sections prevents the segments from shifting out of line as the underlying supports are slid to one side or the other.

Accordingly, when the support assembly is slid to the right, as indicated by arrow 70 in FIG. 4, the tray section 50 remains in place while wedge members 38*a*, 38*b* slide to the right. As this happens, the left end of the tray member slides up the inclined face 72 of the left wedge member 38*a* while the opposite end of the tray member slides down the corresponding face of the other wedge member 38*b*, imparting a downward slope to the right to both the tray member and the overlying pad/turf layers. The stop pin 44*a* on the left end of the rod member 36 contacts the left side 74 of the center block to limit the motion to a predetermined range, while the upper end of the support block is provided with angled top surfaces 76*a*, 76*b* to likewise accommodate the tilting motion of the tray member. When the wedge members are pushed back to a centered position, as shown in FIG. 5, the two edges of the tray member are likewise centered on the inclined faces 72 so that the tray member and overlying pad and turf layers assume a level orientation. Similarly, when the wedge members are pressed to the left, as indicated by arrow 78 in FIG. 6, the edges of the tray member slide along the inclined surfaces 72 to assume an angled orientation opposite that in FIG. 4.

Since, as noted above, the individual segment assemblies are relatively narrow (e.g., 6–12 inches wide), very subtle adjustments can be made to the contour of the playing surface by sliding each segment a lesser or greater extent relative to its neighbors. Moreover, the segments can be slid first to one side and then the next along the length of the assembly, thus providing a variety of swales, ridges, and other contours along the path between the player and the cup. In some embodiments a linkage or connection may be provided between the rods of adjoining segments, or between the adjoining wedge members themselves, such that after a predetermined amount of travel (e.g., 1–2 inches) the adjoining wedge members begin to move together with that which is being pressed, thus avoiding pronounced displacement between adjoining segments and rendering it easier to achieve a smooth contour.

In practice, adjusting the contours of the assembly is very easily accomplished by the player by simply sliding his foot along the floor and pressing against the ends of the wedge members as he does so. A gently curved contour, such as that shown in FIGS. 1–3, is thus very quickly and easily achieved, and the player can make any desired corrections or adjustments by simply walking to the other side of the assembly and pressing his foot against the appropriate segments. Moreover, because each tray member is supported at both ends by the wedge members and in the middle by contact with the central block member (along its center ridge or the angled top surfaces 76*a*, 76*b*), the overall assembly is extremely rigid and stable when walked upon, and is also durable and long-lasting, even under conditions of heavy use.

Furthermore, the use of multiple, identical support segments means that the assembly can be built up to any desired length; in the embodiment that is illustrated in FIGS. 1–3, forty segments are used to construct a green assembly that is approximately 27 feet long and 5½ feet wide, but it will be understood that assemblies having any desired dimensions can be constructed in accordance with the present invention by simply varying the number and size of the support segments and other components.

Figure 8:
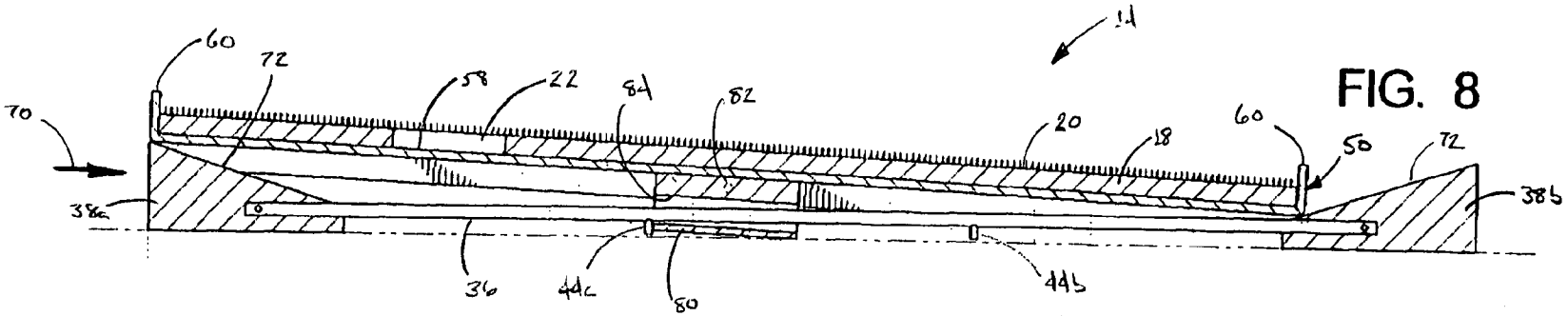
FIGS. 8–10 are cross-sectional views, similar to FIGS. 4–6, showing a second embodiment of the invention in which the center blocks of the segments are fixedly rather than pivotedly mounted to the tray portions thereof.
Figure 9:
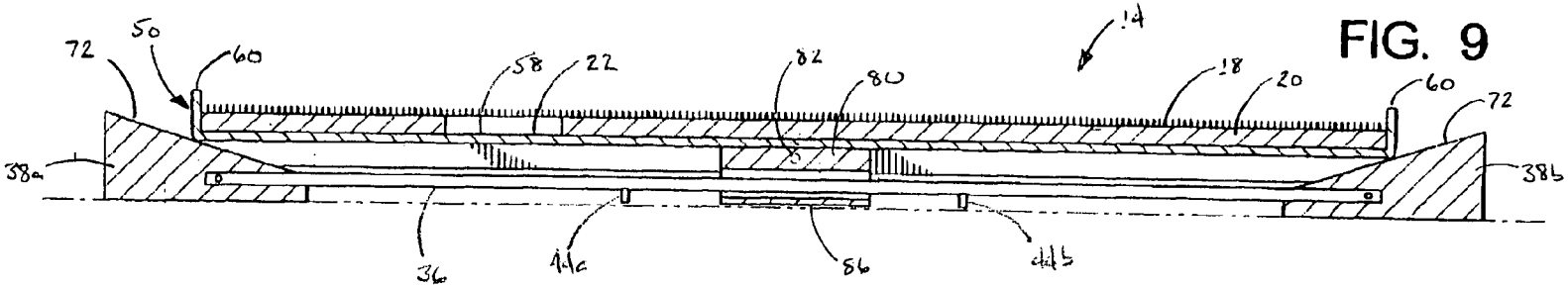
Figure 10:
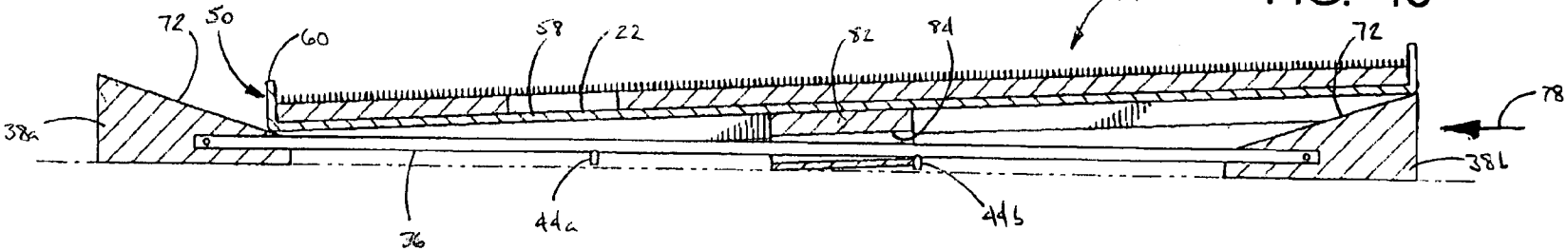

FIGS. 8–10 illustrate a second preferred embodiment of the present invention, this being identical in construction and operation to that described above except for the use of a center block 80 that is fixedly rather than pivotedly mounted to the underside of the tray member 50. In this embodiment, the center block is secured in the channel 64 on the underside of the tray member by a bolt or a pin 82, and has a vertically elongated bore 84 for accommodating motion of the rod member 36 as the tray member rocks from side-to-side. The bottom surface 86 of the center block is spaced slightly above the floor surface when in the neutral position in order to provide clearance for the edges of the block when the assembly is tilted, or the bottom of the block may be chamfered similar to the upper surface of the block 30 described above, so as to provide support at the center of the assembly in all positions. Similar to the block 30 described above, the stop pins 44*a*, 44*b* react with the sides of the block 80 to limit the range of motion of the assembly.

It is to be recognized that various alterations, modifications, and/or additions may be introduced into the constructions and arrangements of parts described above without departing from the spirit or ambit of the present invention.

What is claimed is:

1. A practice putting green, comprising:

a plurality of transversely extending support segments arranged in side-by-side relationship so as to define an elongate playing path;

at least one flexible layer placed over said segments so as to form a playing surface along said playing path; and means for tilting said support segments individually in a direction substantially transverse to said playing path, so that said flexible layer that is supported thereby can be selectively raised or lowered from one side to the other so as to provide the playing path with a variety of contours, said means for tilting said support segments individually comprising first and second wedge members under each of said support segments, said wedge members having inwardly angled inclined surfaces that are in sliding engagement with opposite ends of said support segments.

2. The practice putting green of claim 1, wherein each of said support segments comprises:

a transversely extending tray member having an upper surface for engaging said overlying layer of resiliently flexible material.

3. The practice putting green of claim 1, wherein each of said support segments further comprises:

a transversely extending rod member having said first and second wedge members commonly mounted thereto so that said wedge members will slide together simultaneously in response to pressure exerted on an outer end of one of said wedge members.

4. The practice putting green of claim 3, wherein each of said support segments further comprises:

a center block mounted to an underside of said tray member, said center block having a transverse bore for passage of said rod member therethrough.

5. The practice putting green of claim 4, wherein said rod member comprises:

first and second stop pins mounted on opposite sides of said center block for reacting against side faces of said center block so as to limit side-to-side motion of said rod member and said first and second wedge members that are mounted thereto.

6. The practice putting green of claim 5, wherein said center block is fixedly mounted to said underside of said tray member and wherein said bore in said center block is vertically elongate so as to accommodate transverse rocking movement of said tray member relative to said rod member.

7. The practice putting green of claim 5, wherein said center block is pivotably mounted to said underside of said tray member so as to permit transverse rocking movement of said tray member relative to said rod member.

8. The practice putting green of claim 2, wherein each of the said tray members comprises:

a narrow, substantially flat, transversely extending panel having upstanding wall portions at opposite ends that define a shallow, upwardly facing section of a channel, so that when placed in side-to-side relationship said tray members cooperate to define an elongate channel that receives said flexible layer therein.

9. The practice putting green of claim 8, wherein said at least one flexible layer comprises:

a layer of pliable material having a width selected so that first and second opposite edges of said layer fit closely within said upstanding walls at said ends of said tray members, so that said layer of pliable material holds said tray members from shifting side-to-side relative to one another as said wedge members are adjusted by applying pressure thereto.

10. The practice putting green of claim 1, wherein said at least one flexible layer comprises:

a layer of resiliently flexible cushioning material; and a layer of carpet material overlying said layer of resiliently compressible cushioning material.

11. The practice putting green of claim 1 wherein said at least one flexible layer comprises:

a layer of resiliently flexible cushioning material; and a layer of artificial turf material overlying said layer of resiliently flexible cushioning material.

12. A practice putting green, comprising:

a plurality of transversely extending support segments arranged in side-by-side relationship so as to define an elongate playing path;

at least one flexible layer placed over said segments so as to form a playing surface along said playing path; and means for tilting said support segments individually in a direction substantially transverse to said playing path, so that said flexible layer that is supported thereby can be selectively raised or lowered from one side to the other so as to provide the playing path with a variety of contours;

each of said support segments comprising:

a transversely extending tray member having an upper surface for engaging said overlying layer of resiliently flexible material; and first and second wedge members having inwardly angled inclined surfaces that are in sliding engagement with opposite ends of said tray member.

13. The practice putting green of claim 12, wherein each of said support segments further comprises:

a transversely extending rod member having said first and second wedge members commonly mounted thereto so that said wedge members will slide together simultaneously in response to pressure exerted on an outer end of one of said wedge members.

14. The practice putting green of claim 12, wherein each of the said tray members comprises:

a narrow, substantially flat, transversely extending panel having upstanding wall portions at opposite ends that define a shallow, upwardly facing section of a channel, so that when placed in side-to-side relationship said tray members cooperate to define an elongate channel that receives said flexible layer therein.

15. The practice putting green of claim 14, wherein said at least one flexible layer comprises:

a layer of pliable material having a width selected so that first and second opposite edges of said layer fit closely within said upstanding walls at said ends of said tray members, so that said layer of pliable material holds said tray members from shifting side-to-side relative to one another as said wedge members are adjusted by applying pressure thereto.

* * * * *